United States Patent [19]

Schwab

[11] 4,080,102

[45] Mar. 21, 1978

[54] MOVING BLADE ROW OF HIGH PERIPHERAL SPEED FOR THERMAL AXIAL-FLOW TURBO MACHINES

[75] Inventor: Günter Schwab, Nuremberg, Germany

[73] Assignee: Maschinenfabrik Augsburg-Nurnberg Aktiengesellschaft, Nuremberg, Germany

[21] Appl. No.: 691,291

[22] Filed: Jun. 1, 1976

[30] Foreign Application Priority Data

May 31, 1975 Germany ..... 2524250

[51] Int. Cl.[2] ..... F01D 5/14

[52] U.S. Cl. ..... 416/223 A; 416/237

[58] Field of Search ..... 416/223, 223 A, 237, 416/183; 415/181, DIG. 1

[56] References Cited

U.S. PATENT DOCUMENTS

| | | | |
|---|---|---|---|
| 874,993 | 12/1907 | Rice | 416/223 A X |
| 1,504,710 | 8/1924 | Roberts | 416/242 X |
| 1,553,627 | 9/1925 | Nagler | 416/231 B X |
| 2,918,254 | 12/1959 | Hausammann | 415/DIG. 1 |
| 3,820,918 | 6/1974 | Goldstein | 416/223 A |

FOREIGN PATENT DOCUMENTS

| | | | |
|---|---|---|---|
| 1,053,713 | 3/1959 | Germany | 416/237 |
| 85,284 | 6/1920 | Switzerland | 416/223 |

*Primary Examiner*—Everette A. Powell, Jr.
*Attorney, Agent, or Firm*—Walter Becker

[57] ABSTRACT

A moving blade row of high peripheral speed for thermal axial flow turbo machines, especially for the last stage of condensing steam turbines, the blades of which, when viewed in a radial direction, have their middle and outer regions located in the range of transonic flow. The blade section in the middle range or in the middle and outer regions starting from the trailing edge is formed by two straight lines. The straight line at the suction surface side joins the steadily curved curve of the remaining suction surface side without any distinctive bend, whereas the straight line at the pressure surface side near the trailing edge of the blade joins the steadily curved curve of the remaining pressure surface side with a distinctive bend or discontinuity.

10 Claims, 2 Drawing Figures

MOVING BLADE ROW OF HIGH PERIPHERAL SPEED FOR THERMAL AXIAL-FLOW TURBO MACHINES

The invention relates to a moving blade row of high peripheral speed for thermal axial-flow turbo machines, typically for the last stage of condensing steam turbines in which the middle and outer regions of the blades, viewed in a radial direction, are in the range of transonic flow.

Condensing steam turbines of high output call for relatively long blades in the last stage with pitch diameters of approximately 2500 mm. At a rotative speed of 3000 rpm, the peripheral speed in that stage will be approximately 390 m/sec, the relative velocity of the steam leaving the moving blade at the median section will be approximately 1.4 times the speed of sound ($Ma_2 = 1.4$). Since the steam flow entering the blade rows in the region of the angle of attack $\beta_1$ of 70° to 110° is approximately at a right angle, an inlet Mach No. $Ma_1 = 0.2$ to 0.4 is obtained at the blade rows of steam turbines — depending on the outlet angle adopted.

IN THE DRAWINGS

Figure 1:
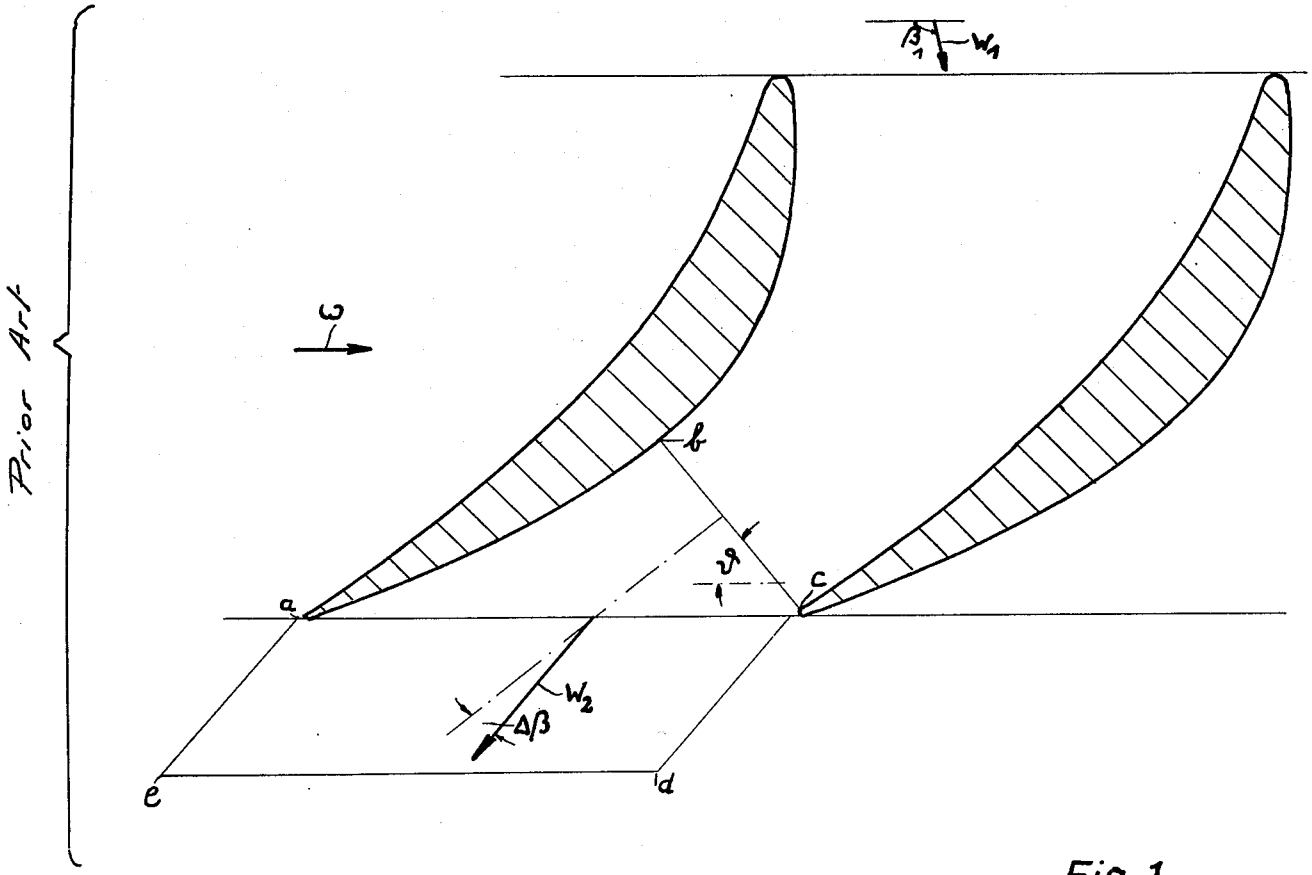
FIG. 1 shows a section through two conventional turbine blades.

The outlet Mach number being only just above unity, it is known practice in steam turbines to use conventional wing sections such as are illustrated in FIG. 1 of the drawing. In this known section, acceleration takes place from the sonic line (Ma = 1) between the points *b* - *c* to the outlet Mach No. $Ma_2 = 1.4$ in the region *a–b–c–d–e*. Supersonic expansion calls for additional space for the flow which is obtained by a rotation through the angle $\Delta\beta$. This process occurs without matching wall surfaces in the blade lattice in an uncontrolled manner in the free space *a–c–d–e*. A disadvantage of these known wing sections is in the high two-dimensional profile losses with increasing outlet Mach numbers $Ma_2$.

The two-dimensional profile loss is defined as $$\xi = 1 - \frac{\frac{w_2^2}{2}}{\Delta i_s + \frac{w_1^2}{2}}$$

in which:

$w_1$ = relative flow velocity at the lattice inlet $w_2$ = relative flow velocity at the lattice outlet $\Delta i_s$ = isentropic blade wheel or runner drop.

The object of the invention is to provide a moving blade row of the type described initially which — compared to conventional wing sections — affords lower profile losses at outlet Mach numbers between 1 and 1.5 and permits smaller outlet angles.

According to the invention, this object is attained by having the blade section formed in the middle range, or in the middle and outer ranges, starting from the trailing edge, by two straight lines of which the straight line at the suction surface side joins the steadily curved curve of the remaining pressure surface side with a discontinuity in the vicinity of the trailing edge of the blade.

The features of the invention enable in particular a higher peripheral efficiency (related to the work transmitted to blade air-foils) to be achieved because the profile losses are lower. The peripheral efficiency is expressed by the equation:

$$\eta_u = \frac{L_w}{\Delta i_s + \frac{c_o^2 - c_2^2}{2}}$$

In this equation:

$L_w$ = peripheral work $\Delta i_s$ = isentropic stage drop $c_o$ = absolute entrance flow velocity of the fluid medium in front of the stage $c_2$ = absolute flow velocity of the fluid medium past the blade wheel or runner drop.

Figure 2:
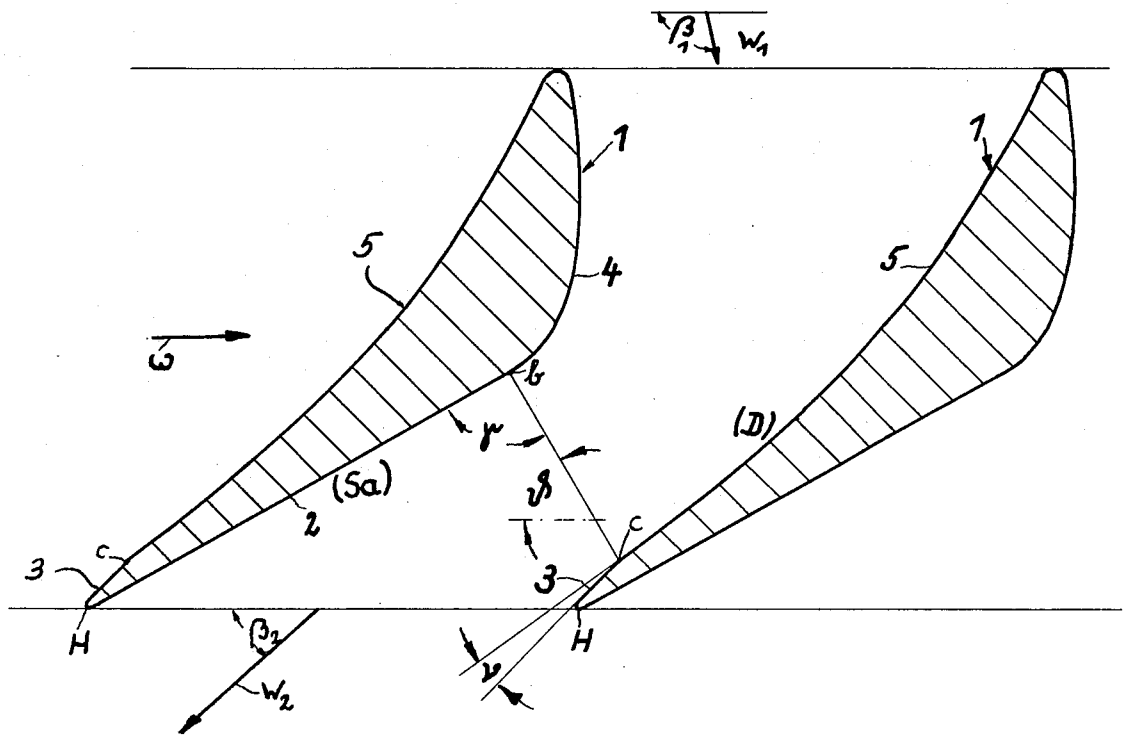
FIG. 2 shows a section through two turbine blades having middle and outer regions with features of the present invention.

This advantage primarily derives from the discontinuity at the pressure surface side because it causes part of the corner expansion which generally is at the trailing edge of the blade to be shifted into the passage between the blades. A typical embodiment of the invention is shown schematically in FIG. 2. This drawing shows part of the development of a cylinder surface that is concentric with the rotor shaft and sections the blades — viewed in a radial direction — in their middle region.

Every blade section 1 according to the invention is formed starting from the trailing edge H with a small edge radius by two straight lines 2 and 3 and two curved sections 4 and 5 with the curved sections 4 and 5 at the leading edge having a large radius compared to that of the trailing edge.

The curved sections 4 and 5 are calculated in line with known practice in a manner that optimum flow conditions are obtained. The straight line 2 at the suction surface side S*a* extends up to the point *b* of the sonic line (Ma = 1) to join the steady curve 4 of the remaining suction surface side without any discontinuity. The straight line 3 of the pressure surface side D is substantially shorter than the straight line 2 and extends from the trailing edge up to the point *c* of the sonic line (Ma = 1) and at point *c* joins the steady curve 5 of the pressure surface side with a discontinuity, i. e. not tangentially, so that a convex corner is formed. The angle $\gamma$ between the line *b* - *c* and the straight line 2 is approximately 90°. The angle $\delta$ between the line *b* - *c* and a horizontal straight line lying in the plane of the drawing is for physical design reasons larger than the angle $\delta$ of the known blade section according to FIG. 1 which is important for the outlet angle $\beta_2$ because it is decreased as a result. The angle $\nu$ between the straight line 3 and the tangent to the curve 5 at point *c* is matched to the supersonic flow regime.

The sections in the extreme region (tip end) of the blades are constructed in the same manner as the sections in the vicinity of the median section described above.

In the radially middle and outer parts of the blade row, flow is transonic, i. e. the steam enters the blade row at subsonic velocity ($Ma_1 = 0.2$ to 0.4); $\beta_1 = 70° - 110°$) to leave the blade row - after a marked deflection - at supersonic velocity which may be at Mach numbers up to 1.5.

It is, of course, to be understood that the present invention is, by no means, limited to the specific showing in the drawings but also comprises any modifications within the scope of the appended claims.

What I claim is:

1. A moving blade row of high peripheral speed for thermal axial flow turbo machines, especially for the last stage of condensing steam turbines, in which each of the blades of said blade row has a suction surface side and a pressure surface side and when viewed in radial direction has a middle region and an outer region located in the range of transonic flow, said middle region starting from the trailing edge being formed by two straight sections respectively located on said suction surface side and on said pressure surface side, the straight section on said suction surface side merging in a steady manner with the remaining suction surface side which latter curves in a steady manner toward said pressure surface side, and said straight section at said pressure surface side near the trailing edge of each of said blades merging with the remaining surface side while forming therewith a distinct angle, the improvement therewith whereby space between adjacent blades from the suction surface side of one blade to the pressure surface side of the adjacent blade at one location has a narrowest cross section forming a flow passage therebetween in boundaries defined by intersection of a straight section and the trailing edge of one blade as well as defined by point intersection of a straight section and the pressure surface side of the adjacent blade, with an angle formed between the latter straight section and a tangent to the pressure surface side at the point intersection being matched to supersonic flow regime.

2. A moving blade row of high peripheral speed for thermal axial flow turbo machines, especially for the last stage of condensing steam turbines, in which each of the blades of said blade row has a suction surface side and a pressure surface side and when viewed in radial direction has a middle region and an outer region located in the range of transonic flow, said middle and outer regions starting from the trailing edge being formed by two straight sections respectively located on said suction surface side on said pressure surface side, the straight section on said suction surface side merging in a steady manner with the remaining suction surface side which latter curves in a steady manner toward said pressure surface side, and said straight section at said pressure surface side near the trailing edge of each of said blades merging with the remaining surface side while forming therewith a distinct angle, the improvement therewith whereby space between adjacent blades from the suction surface side of one blade to the pressure surface side of the adjacent blade at one location has a narrowest cross section forming a flow passage therebetween in boundaries defined by intersection of a straight section and the trailing edge of one blade as well as defined by point intersection of a straight section and the pressure surface side of the adjacent blade with an angle formed between the latter straight section and a tangent to the pressure surface side at the point intersection being matched to supersonic flow regime.

3. A moving blade row according to claim 1, wherein said distinct angle occurs to provide discontinuity at the pressure surface side causing part of corner expansion generally at the trailing edge of the blade to be shifted into the passage between the blades.

4. A moving blade row according to claim 3, wherein the straight section of the pressure surface side is substantially shorter than that of the trailing edge.

5. A moving blade row according to claim 4, wherein steam enters the blade row at subsonic velocity and accordingly flow is transonic in middle and outer parts of the blade row only to leave the blade row after a marked deflection at supersonic velocity.

6. A moving blade row according to claim 5, wherein lower profile losses occur at outlet Mach numbers between 1 and 1.5 and smaller outlet angles are permitted.

7. A moving blade row according to claim 2, wherein said distinct angle occurs to provide discontinuity at the pressure surface side causing part of corner expansion generally at the trailing edge of the blade to be shifted into the passage between the blades.

8. A moving blade row according to claim 7, wherein the straight section of the pressure surface side is substantially shorter than that of the trailing edge.

9. A moving blade row according to claim 8, wherein steam enters the blade row at subsonic velocity and accordingly flow is transonic in middle and outer parts of the blade row only to leave the blade row after a marked deflection at supersonic velocity.

10. A moving blade row according to claim 9, wherein lower profile losses occur at outlet Mach numbers between 1 and 1.5 and smaller outlet angles are permitted.

* * * * *